US006610036B2

(12) United States Patent
Branch et al.

(10) Patent No.: US 6,610,036 B2
(45) Date of Patent: Aug. 26, 2003

(54) EYE DROP DISPENSING SYSTEM

(75) Inventors: John D. Branch, Riverside, CA (US); Steven R. Duhamel, Corona, CA (US); Scott O. Ganaja, San Luis Obispo, CA (US)

(73) Assignee: Vista Innovations, Inc., Riverside, CA (US)

( * ) Notice: Subject to any disclaimer, the term of this patent is extended or adjusted under 35 U.S.C. 154(b) by 0 days.

(21) Appl. No.: 09/776,782

(22) Filed: Feb. 6, 2001

(65) Prior Publication Data

US 2002/0107492 A1 Aug. 8, 2002

(51) Int. Cl.[7] ..... A61M 37/00
(52) U.S. Cl. ..... 604/295; 604/297; 604/302
(58) Field of Search ..... 604/294–301, 604/289

(56) References Cited

U.S. PATENT DOCUMENTS

| | | | | |
|---|---|---|---|---|
| 4,130,247 A | * | 12/1978 | Healy | 239/396 |
| 4,215,689 A | | 8/1980 | Akiyama et al. | 128/214 F |
| 4,641,384 A | | 2/1987 | Landsberger et al. | 4/625 |
| 4,946,452 A | | 8/1990 | Py | 604/301 |
| 5,163,929 A | | 11/1992 | Py | 604/298 |
| 5,171,306 A | | 12/1992 | Vo | 604/295 |
| 5,267,986 A | * | 12/1993 | Py | 222/214 |
| 5,324,258 A | | 6/1994 | Rohrbough | 604/86 |
| 5,336,190 A | | 8/1994 | Moss et al. | 604/153 |
| 5,607,410 A | | 3/1997 | Branch | 604/302 |
| 5,658,252 A | | 8/1997 | Johnson | 604/131 |
| 6,398,766 B1 | | 6/2002 | Branch | 604/302 |

* cited by examiner

*Primary Examiner*—Weilun Lo
*Assistant Examiner*—Linh Truong
(74) *Attorney, Agent, or Firm*—Milton M. Field

(57) ABSTRACT

An eye drop dispensing device includes a trough member with a space to receive a cartridge housing enclosing a collapsible bag containing an ophthalmic liquid and comprising a spring finger applying pressure to the bag. The bag includes a wall pierced by a needle coupling the liquid to pump means through a one-way valve. The pump means includes a plunger biased to a resting position establishing a dosage chamber. Actuator means moves the plunger to enlarge the dosage chamber, causing a drop in pressure which draws a predetermined quantity of the liquid through the one-way valve into the dosage chamber. The actuator means then releases the plunger so that it moves to compress the dosage chamber to pump the liquid in the dosage chamber through a second one-way valve to spray the liquid through pinholes formed in a nozzle angled to direct the liquid as eye drops to the user's eye.

13 Claims, 7 Drawing Sheets

10
12
14
16
18
20
22
24
26
28
38
40
42
44
46
48
51
64
66
118
124
126
128
154
156
158
160
162
166
167
174
176
178
180
182
184

48
90
88
100
92
78
98
94
96
147
145
152
72
74
150
144
146
76
70
106
107
116
20
118
120
117
110
104
112
68
64
108
79
80
86
128
124
84
126
122
141
138
136
134
142
140
146
144
152
150

48
100
98
90
88
94
76
78
96
147
145
152
72
74
80
86
128
124
150
79
82
84
126
122
144
146
70
108
68
64
106
107
116
110
104
112
114
20
118
117
120
141
138
147
134
136
140
145
142
150
152
72
144
146

EYE DROP DISPENSING SYSTEM

BACKGROUND OF THE INVENTION

1. Field of the Invention

This invention relates to an eye drop dispensing system, and, more particularly, to a portable, compact, low-cost eye drop dispensing system using a simple spring-powered pump to spray a predetermined quantity of an ophthalmic liquid into a user's eye.

2. Description of the Prior Art

U.S. Pat. No. 5,607,410, assigned to the same assignee as the present application, shows portable eye wash systems intended for use in an emergency. These systems include a fluid reservoir having a flexible squeeze container mounted on a housing and a trough pivoted at one end to the housing. An eye piece at the other end of the trough is engaged with the user's face adjacent his eye. For enabling the user to view his eye, a mirror is mounted on the housing. A fluid line extends from the housing along the trough to a spray outlet on the trough positioned to spray the user's eye.

Another portable eye wash system is shown in copending Application Ser. No. 09/472,248, filed Dec. 27, 1999, which application is assigned to the same assignee as the present application. In order to facilitate single drop dosing in the system of Ser. No. 09/472,2481, two embodiments of metering spray nozzles are disclosed.

Py U.S. Pat. No. 5,163,929 shows an ocular vial for applying a 20 microliter drop of medicament into the user's eye. A supply cavity feeds the liquid to a drop cavity which is then closed by a piston. When the piston is depressed, the drop is applied through an orifice. This device is a complex eye dropper which does not spray the liquid into the user's eye and includes no means for positioning a spray outlet relative to the user's eye.

Py U.S. Pat. No. 5,267,986 also shows a dispenser including a drop cavity which holds a predetermined volume of fluid to be emitted in the form of a drop. A spring causes expansion of the dispenser to emit a drop through a nozzle. A projecting finger is engaged with the user's eyelid.

Py U.S. Pat. No. 4,946,452 also uses an eyepiece for properly positioning a medicament dispenser. An outer housing is slidably engaged over an inner housing to force the closed end of the vial towards the nozzle and displace a predetermined volume of medicament through a nozzle.

Landsberger et al U.S. Pat. No. 4,641,384 show an eyewash system including a pump operated by batteries.

Vo U.S. Pat. No. 5,171,306 provides an eye drop delivery system which ejects eye drops through nozzles mounted on the frame of a pair of glasses. A fluid reservoir and fluid driving means are located in a separate case.

Akiyama et al U.S. Pat. No. 4,215,689 show injecting apparatus held against a living body and including a reservoir in the form of a bag containing a medical liquid. A needle penetrates a thickened portion of the bag to permit flow of the liquid through a conduit. The liquid is pumped by pump means driven by movement of the living body.

Rohrbough U.S. Pat. No. 5,324,258 shows a reservoir module for a drug delivery system. A medicament vial is closed at one end by a penetrable stopper. A hollow needle pierces the stopper and provides a flow path to a peristaltic pump.

Moss et al U.S. Pat. No. 5,336,190 provide a cassette assembly for an ambulatory medical infusion pump with a reservoir bag having a tube squeezable by a pump mechanism.

Johnson U.S. Pat. No. 5,658,252 discloses a peristaltic drug pump.

As will be apparent from a review of the prior art, the pump-assisted delivery of an accurate dose of an ophthalmic rinse or medicament solution or, more generally, the pump-assisted delivery of medication to a body, have required the use of electric power or, in one case, power derived from movement of the body. It also appears from the prior act that there is a need for a cartridge enclosing a collapsible bag or container for the ophthalmic liquid which is convenient to insert and replace.

SUMMARY OF THE INVENTION

It is an object of this invention to provide an improved portable, low cost eye drop dispensing system with pump-assisted delivery of a predetermined quantity of an ophthalmic liquid as an accurate dose to an eye.

It is an additional object to provide an eye drop dispensing system with a readily replaceable cartridge enclosing a collapsible bag or chamber for the ophthalmic liquid. The cartridge comprises a cartridge housing having a spring finger formed in its top wall applying positive pressure to the collapsible chamber. The collapsible chamber has a piercable entry wall positioned to be pierced by a hollow needle extending through an opening in the cartridge housing for feeding the liquid to pump means for spraying the liquid into a user's eye.

It is a further object to provide an eye drop dispensing system with improved pump means for delivering eye drops through a spray nozzle to a user's eye. The pump means comprises a plunger, having a piston head movable in a cylindrical bore. The plunger is spring biased to move the piston head to a resting position in the bore, the piston head forming a wall of a dosage chamber. Actuator means is engaged by the user to engage and move the plunger in a direction expanding the dosage chamber and thereby creating negative pressure in the dosage chamber. This causes the ophthalmic liquid to flow from a liquid reservoir through a one-way valve into the dosage chamber. After the actuator means has moved the plunger a predetermined distance, an arm on the actuator means engages a sloped surface or ramp to move the actuator means out of engagement with the plunger allowing the plunger to be driven by the biasing spring to move the piston head in a direction to compress the dosage chamber and pump a predetermining dose of the ophthalmic liquid out of the dosage chamber through a second one-way valve and through a spray nozzle into the user's eye.

The spray nozzle comprises a nozzle chamber with an end wall having a plurality of pin holes through which the liquid is sprayed. The nozzle chamber is angled to direct the liquid to the user's eye.

The eye drop dispensing system includes a trough member with an eye piece formed on a wall at the front end of the trough member. A spray space is formed in the trough member behind the wall, and a pump housing is positioned in the trough member behind the spray space. The pump means is located within the pump housing. A cartridge receiving space is provided in the trough member between the rear end of the trough member and the pump housing. The cartridge housing is removably received in the cartridge receiving space from the rear end of the trough member. The spray nozzle is mounted at the front end of the pump housing to spray the liquid through the spray space into a user's eye positioned above the eye piece.

Other objects, features and advantages of the invention will become apparent from the following detailed description and the drawings.

DETAILED DESCRIPTION

Figures 1, 9:
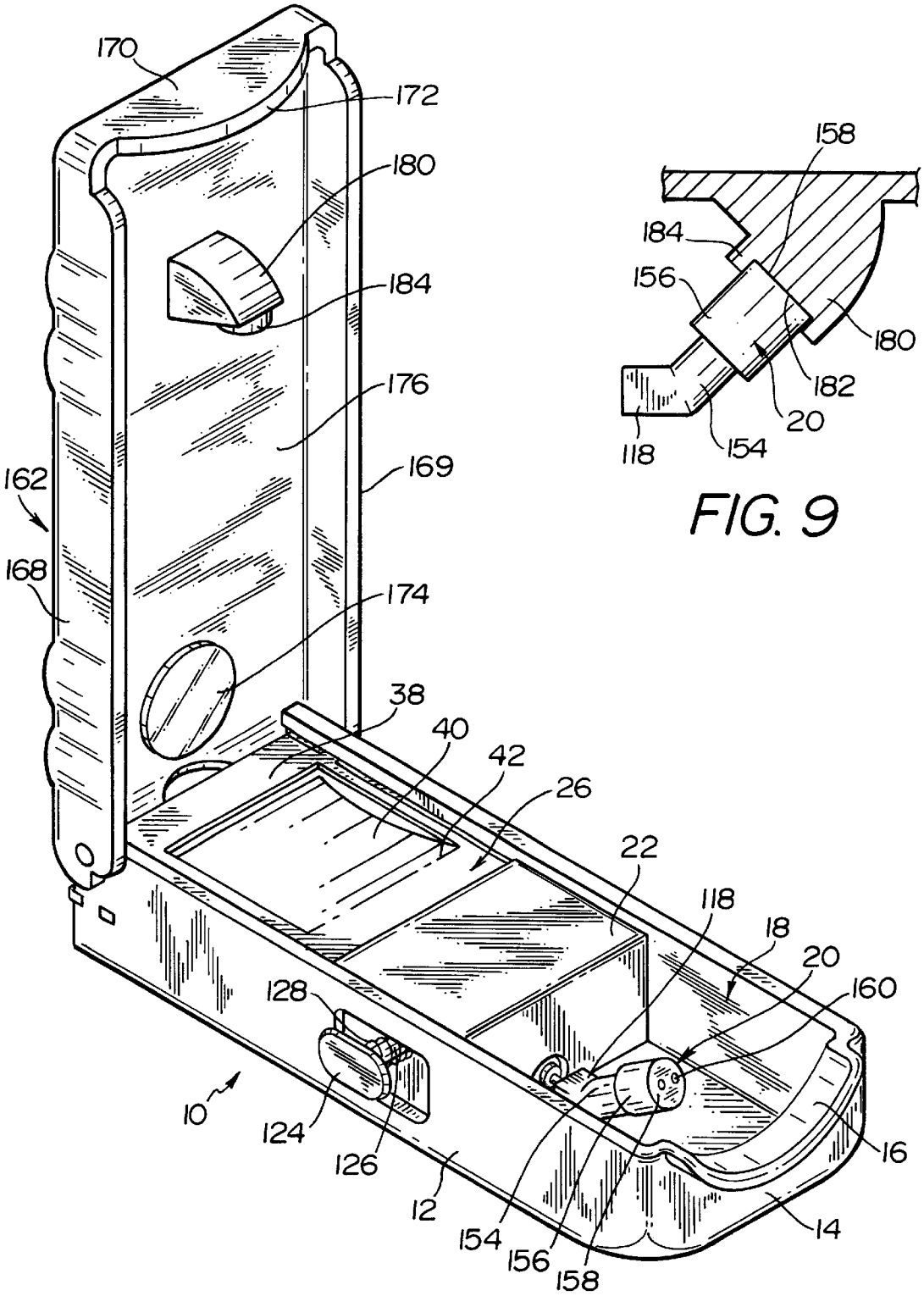
FIG. 1 is a perspective view of an eye drop dispensing system of the invention with the cover pivoted to an open position.
FIG. 9 is a partial cross section view showing the seal engaged with the spray nozzle.

As shown in FIGS. 1–5, an eye drop dispensing system 10 of the invention includes a trough 12 having a front end wall 14 on which an arcuate eye piece 16 is formed. As is known in the art, eye piece 16 will be positioned on a user's face just below an eye to be treated.

A spray space 18 is positioned in trough 12 behind wall 14, and a spray nozzle 20 is located in spray space 18. As will be explained in more detail below, spray nozzle 20 is mounted to receive ophthalmic liquid to be sprayed from pump means located within a pump housing 22 located behind spray space 18.

A cartridge receiving space 24 (see FIGS. 2 and 3) is positioned behind pump housing 22. In order to receive a cartridge housing 26, the bottom wall 28 of cartridge receiving space 24 has a pair of guide grooves 30 and 31 (see FIG. 5) and side walls 32 and 34 (see FIG. 2) each of which has a guide groove 36 (only one of which is seen).

Figures 3, 4:
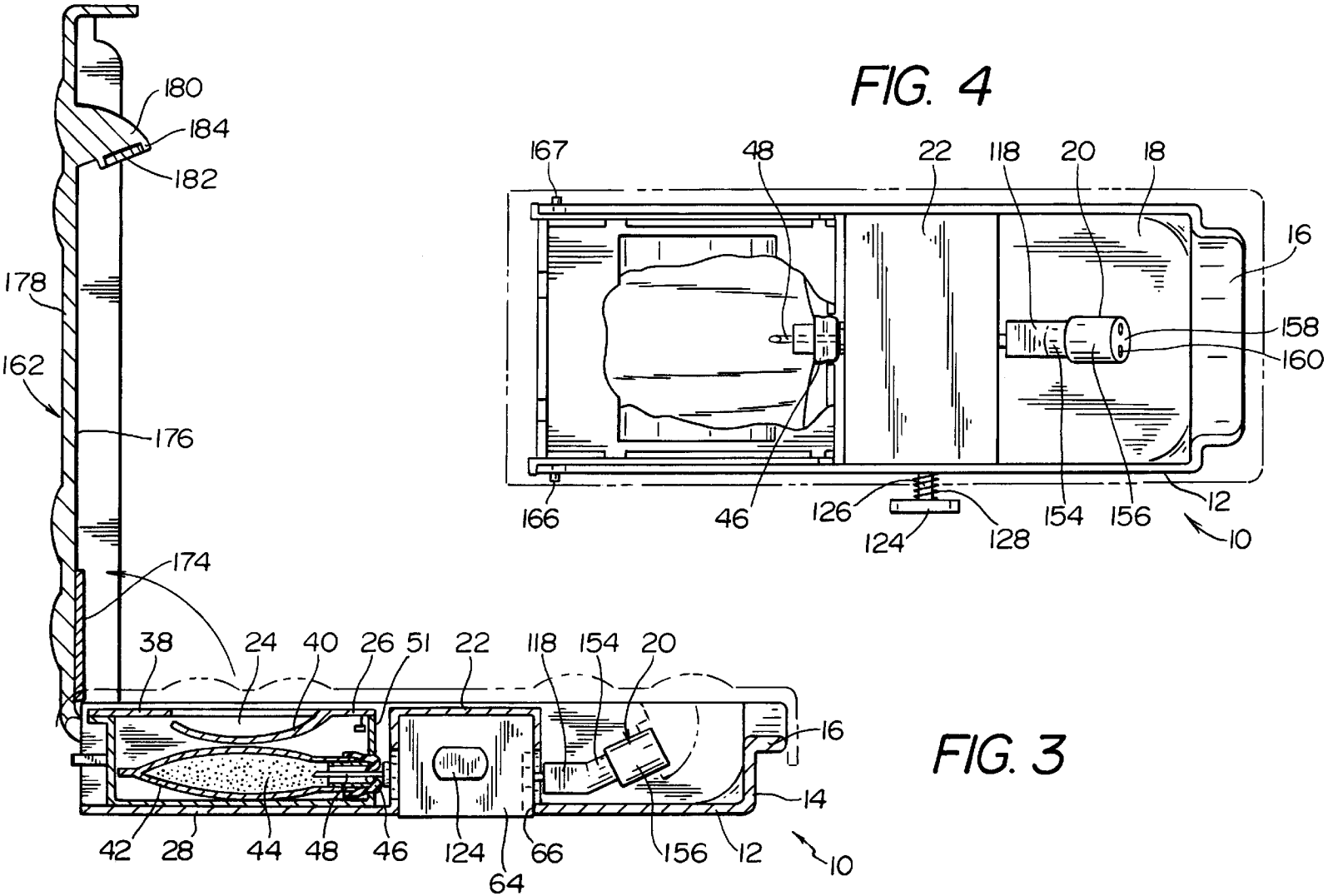
FIG. 3 is a side view, partially in cross section, of the system of the invention.
FIG. 4 is a top view showing the trough member of the system.

Cartridge housing 26 comprises a top wall 38 (see FIG. 3) from which a spring finger 40 is cut, having a base portion 42 (see FIG. 1) connected to top wall 38 at the front end of housing 26. As best seen in FIG. 3, spring finger 40 applies positive pressure to a collapsible bag or chamber 42 formed of a resilient material, such as silicone rubber, and containing the ophthalmic liquid 44.

Figure 5:
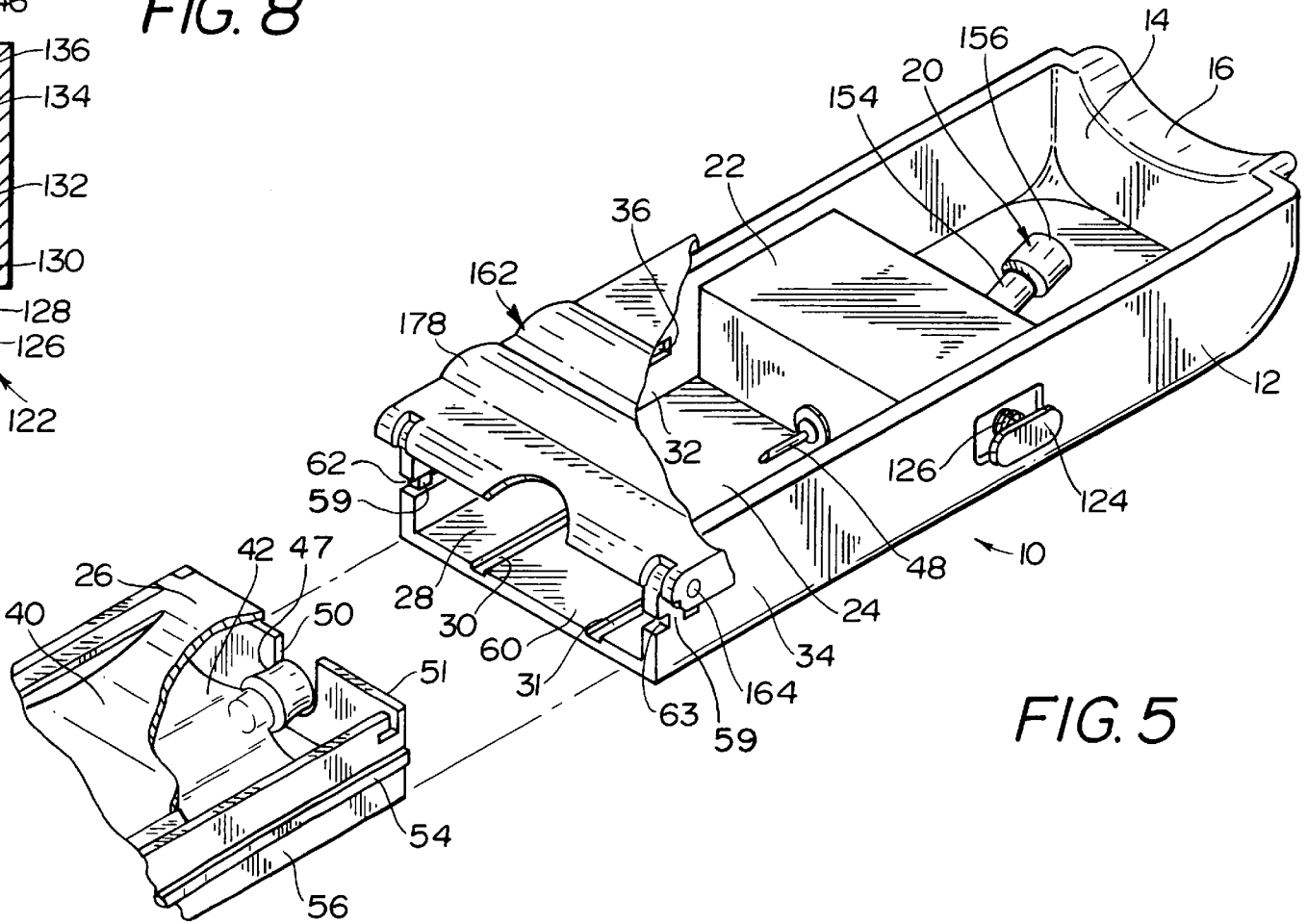
FIG. 5 is a partial perspective view, with parts broken away, showing a cartridge housing in position to be inserted into the trough member of the system.

In order to provide access to liquid 44 within chamber 42, the front end of collapsible bag 42 is provided with a piercable entry wall 46, closing a neck portion 47 (see FIG. 2) of collapsible bag 42. As seen in FIG. 5, a hollow needle 48 extends through an opening 50 at the front end of housing 26. Neck portion 47 of bag 42 is seated in opening 50.

Cartridge housing 26 has parallel rails 52 and 53 (see FIG. 2) extending downwardly from its bottom wall and fitting in guide grooves 30 and 31, respectively. Side rails 54 are provided on the outer surfaces of side walls 56 and 57. These are received in respective side grooves 36. The rear ends of side rails 54 are formed as resilient catches 58 to secure cartridge housing 26 in cartridge receiving space 24 by cooperating with posts 59 and notches 62 and 63 formed at the rear ends of side grooves 36.

Cartridge housing 26 is slid into cartridge receiving space 24 through an opening 60 at the rear end of trough 12 with rails 52, 53 and 54 engaged in guide grooves 30, 31 and 36. When cartridge housing 26 is fully inserted, hollow needle 48 pierces piercable entry wall 46. In this way, ophthalmic liquid 44 is made available for pump means within pump housing 22. When cartridge housing 26 is fully inserted, resilient catches 58 engage notches 62 and 63 at the ends of grooves 36 (see FIG. 5) to retain cartridge housing 26 in cartridge receiving space 24.

Figure 2:
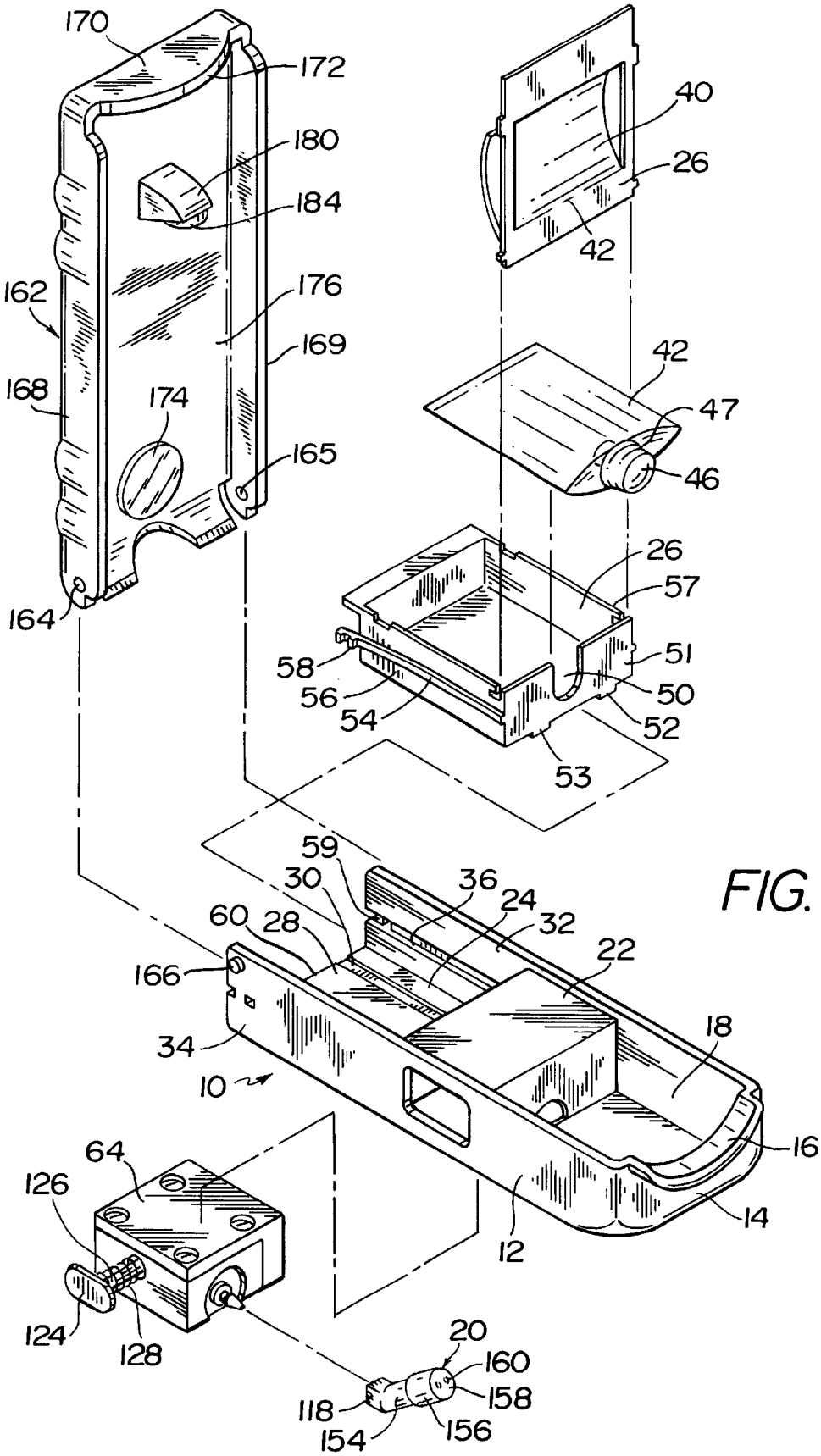
FIG. 2 is an exploded view corresponding to the perspective view of FIG. 1.
Figure 6A:
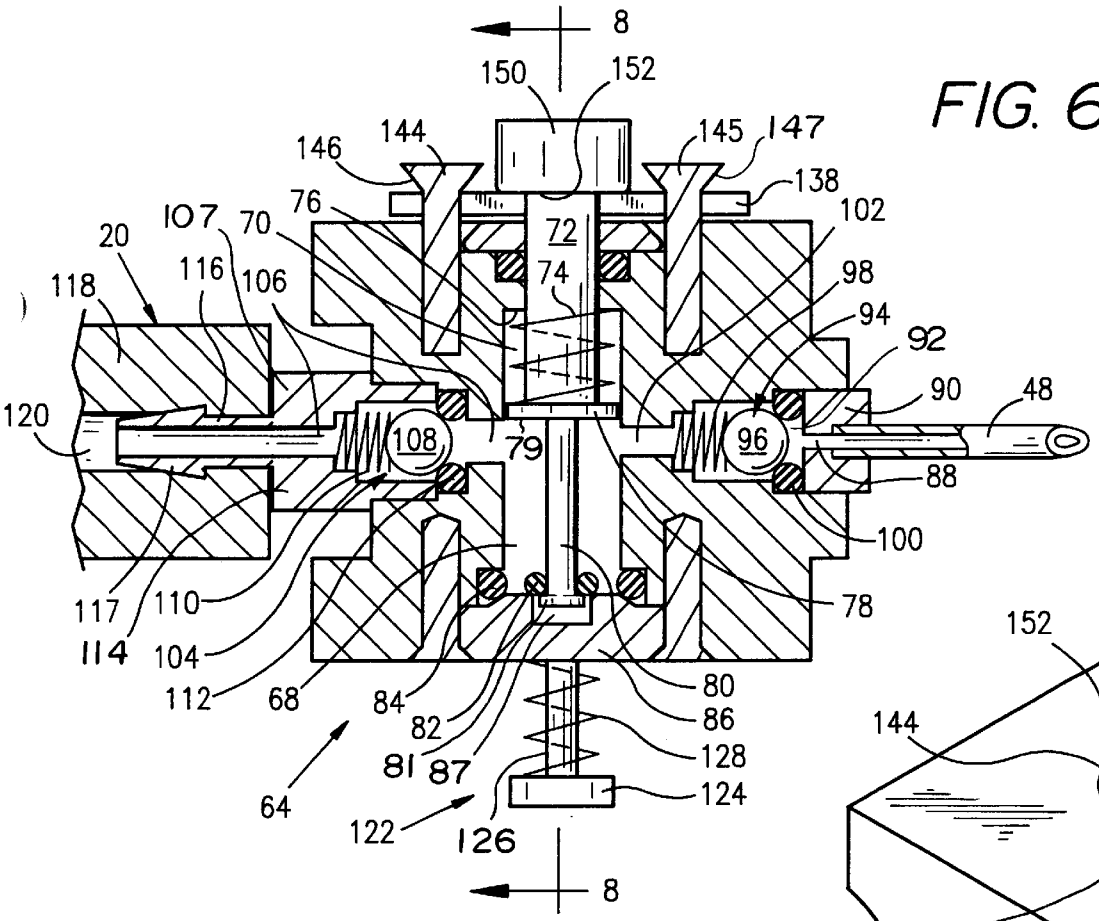
FIG. 6A is a partial cross section view along line 6—6 of FIG. 8 of the pump means of the system in its resting position.

As best seen in FIGS. 2 and 3, pump means 64 is received in pump housing 22 through an opening 66 through the bottom wall 28 of trough 12. Turning to FIG. 6A, which shows pump means 64 in its resting position, pump means 64 comprises a dosage chamber 68 at the bottom of a cylindrical bore 70. A plunger 72 is movable within bore 70 and is biased towards the bottom end (as seen in FIG. 6A) by a spring 74 which is engaged between the top wall 76 of bore 70 and a flange or lip 78 at the bottom end of plunger 72. Flange 78 is so configured and dimensioned that it is movable up and down in bore 70, serving as a piston head 79 forming the top wall of dosage chamber 68. Plunger 72 has a rod extension 80 of smaller diameter below piston head 79. An O-ring cushion 82 embraces the lower end of rod 80, resting, in part, on a flange or lip 81 at the bottom end of rod 80. When plunger is in its resting position, flange 81 is received in a bore 87 in end wall 86, while O-ring 82 rests, in part, on the portion of end wall 86 surrounding bore 87. An O-ring 84 seals chamber 68 where it terminates at end wall 86.

Hollow needle 48 is mounted at one end in a bore 88 in a ring 90. Bore 88 leads to a valve chamber 92 of a one-way valve 94, which comprises a ball 96 which is biased by a spring 98 to a closed position in which ball 96 is pressed against an O-ring 100. One way valve 94, when open, permits liquid to flow into dosage chamber 68 through inlet passageway 102.

Figures 6B, 7B:
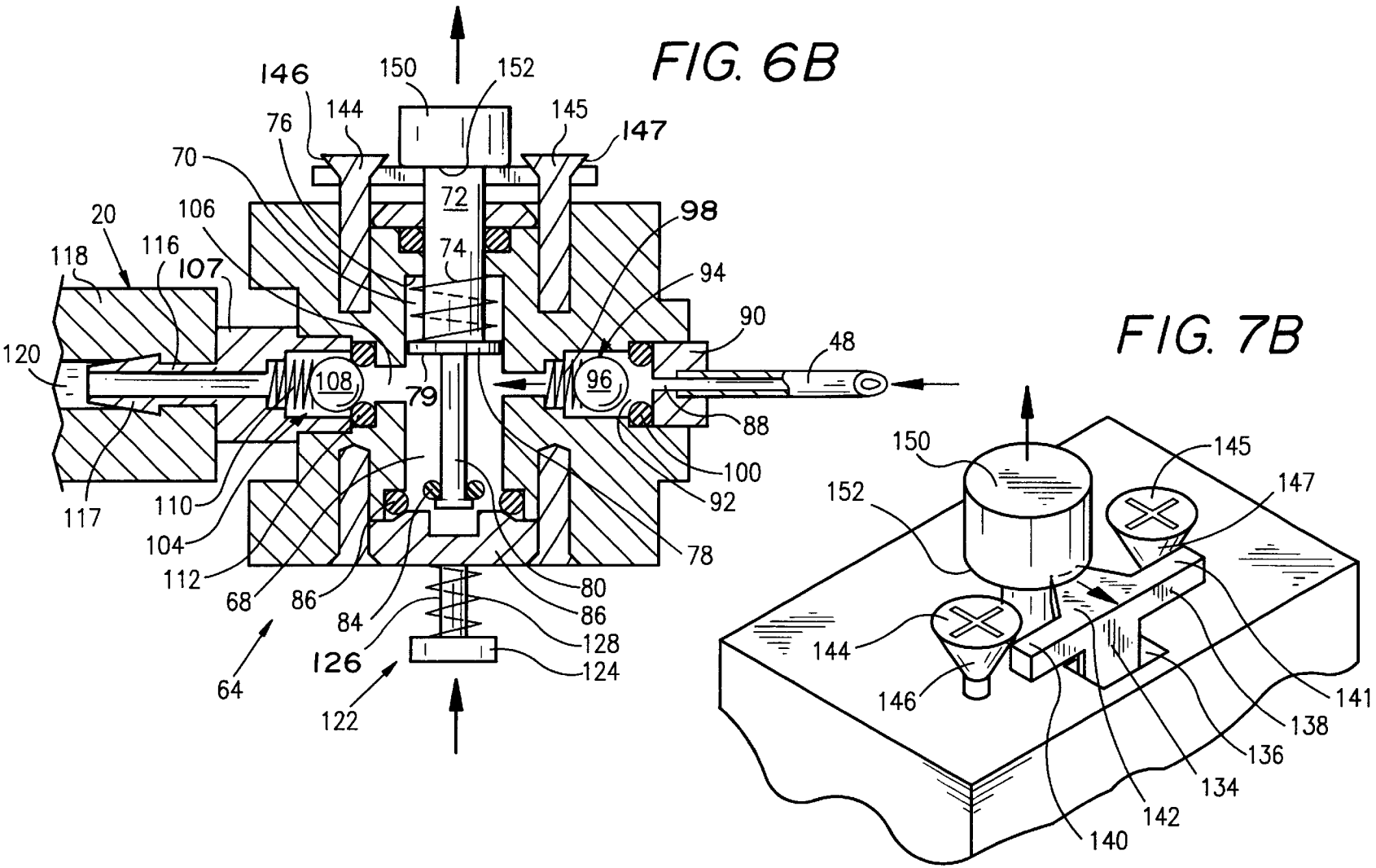
FIG. 6B is a cross section view corresponding to FIG. 6A of the pump means after a user has partially depressed the actuator button with the plunger raised.
FIG. 7B is a partial perspective view showing the plunger in its raised position with the side engagement arms of the actuator engaged with sloping surfaces so that the actuator is moved laterally with the central lifting arm portion still engaged with the head of the plunger.
Figures 6C, 7C:
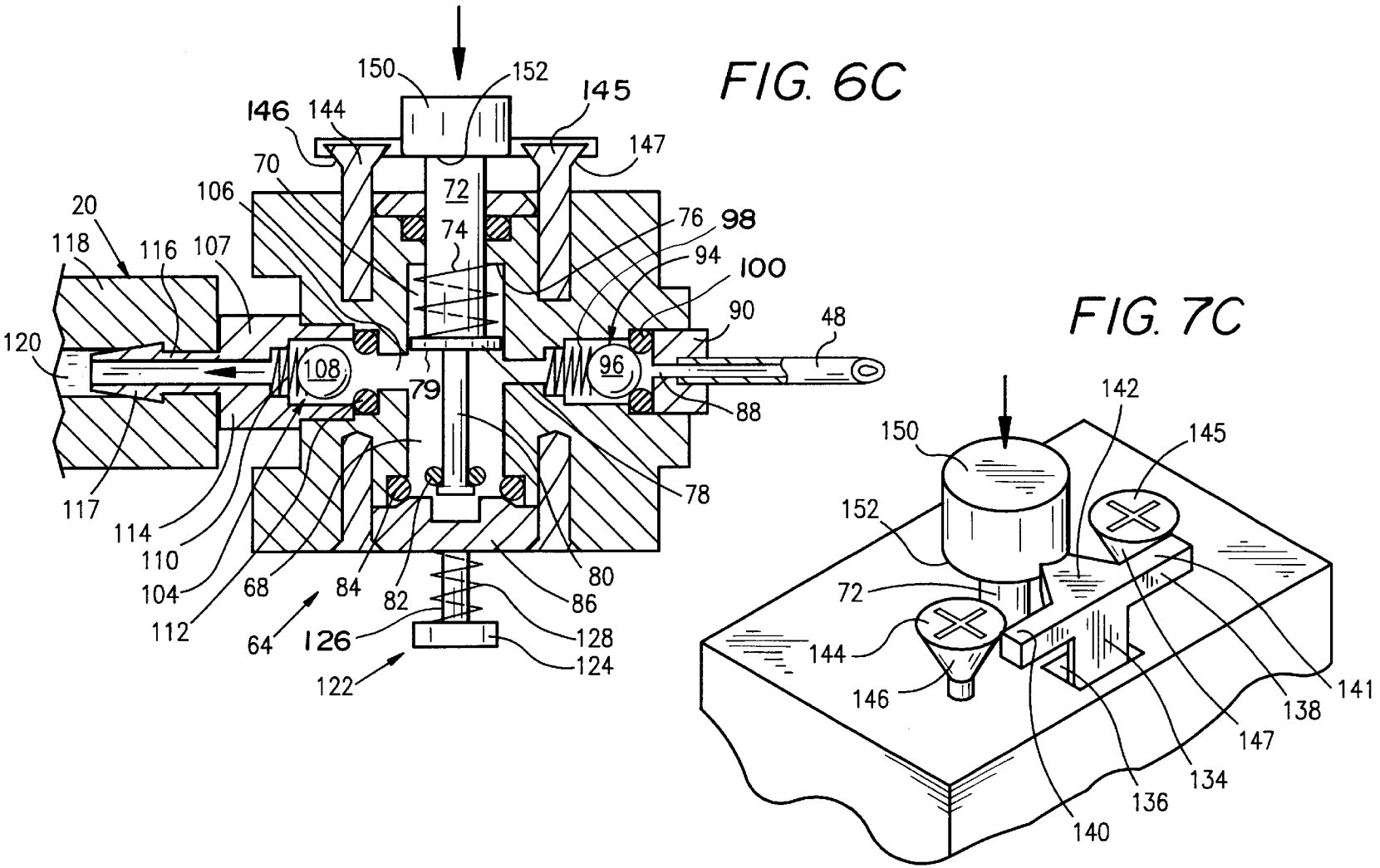
FIG. 6C is a cross section view corresponding to FIG. 6A of the pump means with the plunger moving back into the dosage chamber and the actuator button fully depressed with the central lifting arm portion of the actuator moved out of engagement with the head of the plunger.
FIG. 7C is a partial perspective view showing the side engagement arms of the actuator engaged with the sloping surfaces so that the actuator is moved laterally with the central lifting arm portion moved free of the head of the plunger and with the plunger moving back into the dosage chamber.

A second one-way valve 104 is positioned in outlet passageway 106 extending from dosage chamber 68 through outlet member 107 and comprises a valve ball 108 which is biased by a spring 110 to a closed position pressing against O-ring 112. Beyond valve 104, outlet passageway 106 extends through a thick-walled portion 114 of member 107 and then through a thin walled outlet portion 116. A tapered connector ring 117 is formed on the outer side of outlet portion 116. As seen in FIGS. 6A, 6B and 6C, nozzle member 20 has an inlet portion 118 with an inlet passageway 120. Nozzle member 20 is formed of a plastic material, such as ABS or polypropelene, which permits inlet portion 118 to be slipped over the end of outlet portion 116 and snap over tapered ring 117 to secure nozzle 118 on outlet portion 116.

Pump means 64 also includes acuator means 122. An actuator button 124 projects from one side of pump means 64 (see FIGS. 1, 2, 3, 4, 5, 6A, 6B, 6C and 8) and is mounted on an end of actuator rod 126 and is biased outwardly of pump means 64 by a spring 128.

Figure 8:
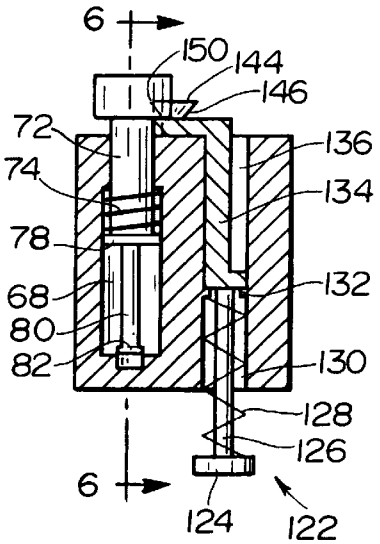
FIG. 8 is a partial cross section view along line 8—8 of FIG. 6A.
Figure 7A:
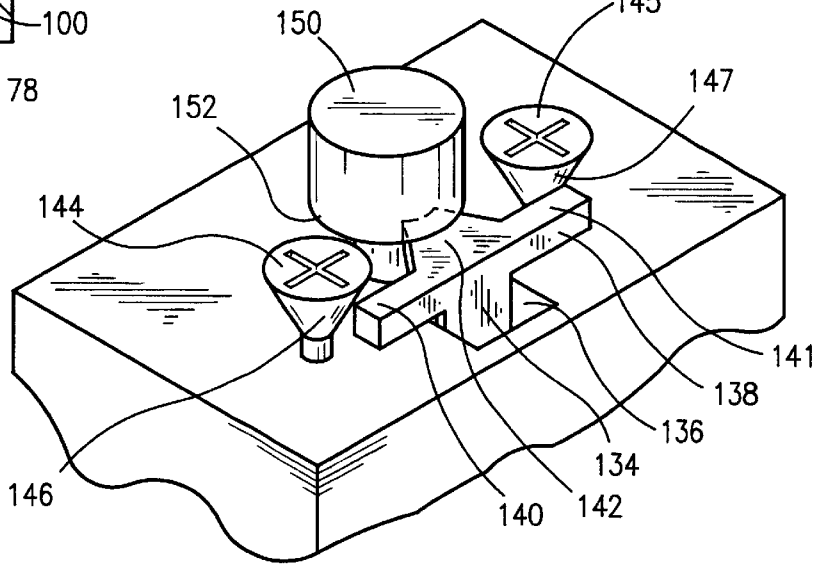
FIG. 7A is a partial perspective view showing the central engagement arm of the actuator means engaged with the head of the plunger.

As seen in FIG. 8, rod 126 extends into a bore 130 and is surrounded by spring 128 within bore 130. Rod 126 is widened to form a shoulder 132 against which one end of spring 128 presses, the other end pressing against the inside surface of button 124. An extension 134 of actuator rod 126 extends through a rectangular extension 136 of bore 130. As seen in FIGS. 7A, 7B, and 7C, extension 134 terminates in an actuator arm member 138 which has lateral arm portions 140 and 141 and a lifting arm portion 142.

As best seen in FIGS. 6A, 6B, 6C, 7A, 7B, 7C, and 8, screw members 144 and 145 are positioned near arm member 138 so that respective sloped surfaces or ramps 146 and 147 will become engaged with respective arm portions 140 and 141 as arm member 138 is raised, as will be presently explained.

It will be noted that the upper end (as seen in FIGS. 6A, 6B, and 6C) or plunger 72 is provided with an enlarged head 150 forming a lip 152 which, as will be explained below, will be engaged by lifting arm portion 142 to lift plunger 72.

Spray nozzle 20, as mentioned above, includes an inlet portion 118 which slips over outlet portion 116 of pump means 64. Inlet portion 118 is connected to a tubular angled portion 154, which is tipped an angle of 45 degrees to inlet portion 118, and which, in turn, is connected to a hollow cylindrical nozzle chamber member 156. An end wall 158 closes hollow chamber member 156. In order to enable spraying of the ophthalmic liquid, a plurality of pinholes 160 are provided through end wall 158. When spray nozzle 20 is mounted on outlet member 107, the angled portion 154 will so position end wall 158 that the liquid will spray through pinholes 160 in a direction to enter a user's eye when eye piece 16 is positioned just beneath the user's eye.

The device includes a cover 162 which includes a pair of pivot holes 164 and 165 adjacent one end. These pivot holes are mounted on pivot pins 166 and 167 which project from respective side walls 34 and 32 of trough 12 adjacent the rear end thereof. Cover 162 has a pair of side walls 168 and 169 which, when cover 162 is in its closed position, fit just outside the outer sides of side walls 34 and 32, respectively, of trough 12. The front end of cover 162 (the end opposite the pivoted end) has an end wall 170 having an arcuate edge 172 which is complementary to and is received on the arcuate surface of eye piece 16.

As is known in the art, a mirror 174 is glued to the inner side 176 of a top wall 178 of cover 162. Mirror 174 is so placed that a user who has placed eye piece 16 beneath his or her eye will be assisted in properly positioning the device by observing his or her eye in mirror 174.

A seal 180 is formed on inner surface 176 of top wall 178 and has a sealing surface 182 (see FIG. 3) which is so positioned and angled that, when cover 162 is in its closed position, sealing surface 182 abuts and seals end wall 158 and pinholes 160 of nozzle 20. In order to enhance the sealing function of seal 180, it is provided with a peripheral lip 184 which, when cover 162 is in its closed position, snugly embraces nozzle end portion 156.

When eye drop dispensing system 10 is used, the user must first insert a cartridge housing 26 in cartridge receiving space 24. This is accomplished by inserting housing 26 into space 24 through rear opening 60 of trough 12. With the end wall 51 of cartridge housing 26 through which opening 50 extends being inserted into opening 60 first, bottom rails 52 and 53 are engaged with guide grooves 30 and 31, respectively, in bottom wall 28 of trough 12 and side rails 54 and 56 are engaged with side grooves 36 formed in side walls 32 and 34 of trough 12. Cartridge housing is then slid forward until piercable end wall 46 of collapsible bag 42 is pierced by needle 48 extending rearwardly from pump housing 22. This couples collapsible bag with valve chamber 92 of one-way valve 94. As mentioned above, spring finger 40 of cartridge housing 26 applies pressure upon collapsible bag 42. However, this pressure is not sufficient to permit the fluid 44 in bag 42 to overcome the bias provided in one-way valve 94 by spring 98. Rather, the pressure on bag 42 primes one way valve 94 to make it more responsive to a drop in pressure in dosage chamber 68 upon movement of plunger 72 as will presently be described.

The normal resting position of plunger 72 is shown in FIG. 6A. Bias spring 74 is engaged with flange 78 at the lower end of plunger 72 and biases plunger 72 to its lowest position with piston head 78 seated in bore 70 above dosage chamber 68. This lowest position is established by the engagement of O-ring 82 with wall 86. At this time, lifting arm portion 142 of actuator arm member 138 is spaced below the underside of lip 152 of plunger head 150 as shown in FIG. 7A.

When the user presses actuator button 124, the bias of spring 128 is overcome and rod extension 134 and lifting arm portion 142 are lifted until lifting arm portion 142 engages the underside of plunger head lip 152, as shown in FIG. 7B, causing plunger 72 to be lifted overcoming the bias of spring 74. At the same time, arm portions 140 and 141 engage sloped or ramp surfaces 146 and 147 of screws 144 and 145, respectively. This engagement causes lateral movement of arm member 138 away from plunger 72, but, as shown in FIG. 7B, lifting arm portion 142 is not yet free of engagement with underside 152 of plunger head 150. As is shown in FIGS. 6B, lifting arm portion 142 has brought plunger 72 to a raised position while raising piston head 79 and enlarging dosage chamber 68. This results in a drop in pressure within dosage chamber 68. This drop in pressure to the left of ball 96, when added to the positive pressure applied to the right side of ball 96 by liquid in passageway 88 by virtue of the pressure applied to collapsible bag 42 by spring finger 40, is sufficient to overcome the bias of spring 98 and force valve ball 96 to move off O-ring 100 opening one-way valve 94. Ophthalmic liquid 44 then flows from bag 42 into dosage chamber 68 to fill chamber 68 with the proper dosage of the eye drops to be sprayed into the user's eye.

As actuator rod extension 134 is further raised, arm portions 140 and 141 slide further up ramp surfaces 146 and 147, respectively. This causes arm portions 140 and 141 and, with them, actuator arm extension 134, to move further away from plunger 72 until, as shown in FIG. 7C, head 150 becomes free of and disengaged from lifting arm portion 142. At this time, bias spring 74 drives plunger 72 downwardly to move piston head 79 in a direction compressing dosage chamber 68, as shown in FIG. 6C. As chamber 68 is compressed, the pressure within dosage chamber 68 increases forcing valve ball 108 of one-way valve 104 to overcome the bias of spring 110 and open one-way valve 104. This permits the ophthalmic liquid to flow from dosage chamber 68 into outlet member 107 and thin walled outlet portion 116 into inlet passage 120 of nozzle 20. Being under pressure, the liquid flows through nozzle 20 and pinholes 160 and is sprayed as eye drops into the user's eye.

Movement of plunger 72 under the influence of bias spring 74 continues until plunger 72 is returned to the resting position of FIG. 6A. When O-ring 82 comes into contact with the portion of end wall 86 surrounding bore 87, the impact is cushioned by the elastomeric material from which O-ring 82 is made.

After lifting arm portion 142 is moved free of plunger head 150, the user releases actuator button 124. Bias spring 128 then moves actuator rod 126 and actuator rod extension 134 back to their resting positions as shown in FIGS. 6A, 7A and 8.

It will be observed that the quantity of ophthalmic liquid drawn into dosage chamber 68 is governed by the length of the upward stroke of plunger 72 and that the length of this upward stroke is determined by the placement of ramp surfaces 146 and 147, which establish when arm lifting portion 142 is moved free of plunger head 150. Thus, when the user presses actuator button 124, a predetermined quantity of the ophthalmic liquid is drawn into dosage chamber 68 and the same predetermined quantity is sprayed as eye drops into the user's eye.

Although the body of pump means 64, in which bore 70 and dosage chamber 68 are formed, and plunger 72, including flange 78, piston head 79 and rod extension 80, and actuator means parts 124, 126, 134 and 138 may be formed of metal, it is more economical, and therefore preferable, to form these parts of a plastic material, such as ABS or polypropelene. Because valve springs 98 and 110 are formed of stainless steel, there is no concern that these springs will be degraded by contact with the ophthalmic liquid flowing through the valves. However, bias spring 74, which is shielded from the ophthalmic liquid in dosage chamber 68 by flange 78, and bias spring 128, which also does not come in contact with the ophthalmic liquid, may be made of a more economical resilient material, such as polythelene. O-rings 82, 84, 100, and 112 may be formed of rubber or silicone rubber. Valve balls 94 and 108 may be formed of stainless steel, ABS, or polypropelene.

It should be understood that the foregoing description of the invention is intended merely to be illustrative and other modifications, embodiments and equivalents may be apparent to those skilled in the art without departing from the spirit and scope of the invention.

The invention claimed is:

1. An eye drop dispensing system comprising:

a trough member having a front end and a rear end;

an eye piece formed on a wall at the front end of said trough member;

a spray space formed in said trough member behind said wall;

a pump housing positioned in said trough member behind said spray space and pump means within said pump housing;

a cartridge receiving space provided in said trough member between the rear end of said trough member and said pump housing;

a cartridge housing removably received in said cartridge receiving space from said rear end of said trough;

a liquid container positioned in said cartridge housing;

liquid coupling means coupling said liquid container to said pump means; and spray nozzle means mounted at the front end of said pump housing and coupled to receive the liquid output from said pump means and to spray said liquid output into a user's eye positioned above said eye piece.

2. An eye drop dispensing system of claim 1, wherein said liquid container is a collapsible chamber and wherein said cartridge housing contains means to apply positive pressure to said collapsible chamber.

3. An eye drop dispensing system of claim 2, wherein said means to apply positive pressure to said collapsible chamber comprises a spring finger formed in a top wall of said cartridge housing, said spring finger engaging and applying said positive pressure to said collapsible chamber.

4. An eye drop dispensing system of claim 1, wherein said liquid container is a collapsible chamber and wherein said liquid coupling means comprises a hollow needle extending through an opening in said cartridge housing to pierce said collapsible chamber.

5. An eye drop dispensing system of claim 4, wherein said collapsible chamber has a piercable entry wall adjacent said opening and wherein said hollow needle is positioned to pierce said piercable entry wall when said cartridge housing is placed in said cartridge receiving space.

6. An eye drop dispensing system of claim 1, wherein said pump means comprises a bore including a dosage chamber for receiving liquid from said liquid container, a first one-way valve permitting flow of said liquid from said liquid container into said dosage chamber, a plunger having a piston head, seated in said bore establishing a top wall of said dosage chamber, means biasing said plunger to bring said piston head to a resting position, and actuator means to engage said plunger and move said plunger and piston head to expand said dosage chamber creating negative pressure in said dosage chamber causing some of said liquid to flow from said liquid chamber, through said first one-way valve and fill said dosage chamber, the volume of said liquid in said dosage chamber being the size of a desired dose.

7. An eye drop dispensing system of claim 6, wherein said pump means further comprises disengagement means causing said actuator means to disengage from said plunger, permitting said means biasing said plunger to drive said piston head to compress said dosage chamber to pump said liquid in said dosage chamber out of said dosage chamber through a second one-way valve and through said spray nozzle means.

8. An eye drop dispensing system of claim 6, wherein said plunger has a projection extending outwardly from said plunger and wherein said actuator means comprises a rod having a first arm positioned to engage said projection, rod biasing means to bias said rod to move said first arm away from engagement with said projection, said actuator rod having an actuator button engageable by the user to move said actuator rod against said bias of said rod biasing means to engage said first arm with said projection to move said plunger in a direction to expand said dosage chamber.

9. An eye drop dispensing system of claim 8, wherein said pump means further comprises disengagement means causing said first arm of said actuator means to disengage from said projection of said plunger permitting said means biasing said plunger to drive said piston head in a direction to compress said dosage chamber to pump said liquid in said dosage chamber out of said dosage chamber through a second one-way valve through said spray nozzle means, said disengagement means comprises sloped surface means, and said rod has a second arm adapted to engage said sloped surface means after said first arm engages said projection and said plunger has been moved to lift said piston head to expand said dosage chamber, said sloped surface means moving said rod away from said plunger to move said first arm free of said projection, whereby said means biasing said plunger is free to move said piston head in a direction to compress said dosage chamber.

10. An eye drop dispensing system of claim 1, wherein said spray nozzle means comprises a nozzle chamber with an end wall, said end wall having a plurality of pinholes through which said liquid is sprayed.

11. An eye drop dispensing system of claim 10, wherein said nozzle chamber is angled to direct said liquid to the user's eye.

12. An eye drop dispensing system comprising:

an eyepiece adapted to engage a user's face to position said system and to apply eye drops to a user's eye;

housing means within said system for containing a supply of liquid;

pump means for pumping liquid from said housing means; and spray nozzle means coupled to receive said liquid from said housing and adapted to spray said liquid into said user's eye, said spray nozzle means having a nozzle chamber with an end wall, said end wall having a plurality of pinholes through which said liquid is sprayed.

13. An eye drop dispensing system of claim 12, wherein said nozzle chamber is angled to direct said liquid to the user's eye.

* * * * *